US005684475A

United States Patent [19]

Krause et al.

[11] Patent Number: 5,684,475

[45] Date of Patent: Nov. 4, 1997

[54] METHOD FOR RECOGNIZING DISRUPTIONS IN ROAD TRAFFIC

[75] Inventors: Bernhard Krause, Köln; Martin Pozybill, Stuttgart, both of Germany

[73] Assignee: INFORM Institut für Operations Research und Management GmbH, Aachen, Germany

[21] Appl. No.: 639,957

[22] Filed: Apr. 29, 1996

[30] Foreign Application Priority Data

Apr. 28, 1995 [DE] Germany ..... 195 15 229.8

[51] Int. Cl.[6] ..... G08G 1/01

[52] U.S. Cl. ..... 340/934; 340/933; 340/936; 364/436

[58] Field of Search ..... 340/934, 933, 340/936, 917, 916; 364/436

[56] References Cited

U.S. PATENT DOCUMENTS

| | | | |
|---|---|---|---|
| 3,689,878 | 9/1972 | Thieroff . | |
| 4,023,017 | 5/1977 | Ceseri . | |
| 4,750,129 | 6/1988 | Hengstmengel et al. . | |
| 5,281,964 | 1/1994 | Iida et al. | 340/933 |
| 5,509,082 | 4/1996 | Toyama et al. | 382/104 |
| 5,528,234 | 6/1996 | Mani et al. | 340/933 |
| 5,566,072 | 10/1996 | Momose et al. | 364/436 |

OTHER PUBLICATIONS

AVE Verkehrs– und Informationstechnik GmbH "MAVE—die Komplettlösung für modernes Verkehrsmanagement", 12 pages.

F. Busch et al., Siemens "Automatische Störfallerkennung auf Autobahnen mit Hilfe von Fuzzy–Logik", 8 pages.

P. Böhnke, "A System for Automatic Incident Detection and Management" Proceedings ISATA, 28th International Symposium, Stuttgart, Sep. 1995, 8 pages.

*Primary Examiner*—Jeffery Hofsass
*Assistant Examiner*—Davetta Woods
*Attorney, Agent, or Firm*—W. G. Fasse; W. F. Fasse

[57] ABSTRACT

In a method for recognizing disruptions in road traffic within a road sector that is to be monitored at respective measurement cross-sections at the beginning and at the end of the sector, the number and the speed of the vehicles passing through the measurement cross-sections are continuously acquired as measured data, which are collected and compiled cyclically during finite measurement intervals to provide average values of the traffic flow and the speed, and are then evaluated. Each measurement cross-section thereby encompasses all lanes of traffic that can be used in one direction of travel. In order to recognize disruptions in road traffic, independent of the traffic condition and with the smallest possible loss in time and low investment in data processing, a prognosis value of the traffic flow for the vehicles passing through the end of the road sector is calculated cyclically from the average values determined for the beginning of the road sector, taking into consideration the length of the road sector and an assumption about the driving behavior of the detected vehicles. Describable uncertainties arising in determining the prognosis value are taken into consideration by fuzzy modeling. The prognosis value is compared with the average value of the traffic flow at the end of the road sector determined from the measured data acquired at the measurement cross-section at the end of the road sector and the respective difference in traffic flow is determined cyclically. A cycle-spanning summation of the values of the difference in traffic flow is carried out and the number of the additional vehicles remaining in the road sector to be monitored is continuously determined.

14 Claims, 1 Drawing Sheet

METHOD FOR RECOGNIZING DISRUPTIONS IN ROAD TRAFFIC

FIELD OF THE INVENTION

The invention relates to a method for recognizing disruptions in road traffic within a road sector that is to be monitored. At each respective measurement cross-section provided at the beginning and at the end of the road sector, the number and the speed of the vehicles passing the measurement cross-sections are continuously acquired or ascertained as measured data, and are then collected and compiled cyclically during finite successively numbered measurement intervals to provide average values of the traffic flow and the speed, and are then evaluated. Each measurement cross-section encompasses all traffic lanes open to traffic in one direction of travel.

BACKGROUND INFORMATION

Due to the continuously increasing volume of road traffic, traffic influencing systems with variable message traffic signs are being used with increasing frequency to collectively control such road traffic on multi-lane roadways, whereby various methods of recognizing disruptions in road traffic are applied in the control of such systems. The motivation for investing in such systems and for developing the associated methods for recognizing disruptions is the fact that the risk of follow-up or secondary accidents can clearly be reduced through the warnings delivered by the variable message signs to the following or subsequent traffic that is moving toward the site of a disruption such as a breakdown or a collision. It is especially significant in this context to achieve the most reliable and rapid recognition possible of the disruption, i.e. a reduction in the critical time between the occurrence and the securing of a disruption.

Currently, road traffic is measured generally by measuring methods that receive or pick-up data locally at so-called measurement cross-sections from single vehicles. It is typical to monitor individual sectors of road that are each bounded at the beginning and at the end thereof by respective measurement cross-sections, i.e. sectors of one traffic lane. In traffic engineering, the value "traffic flow" is defined as the number of vehicles detected per unit of time, from which the unit thereof is derived as [vehicles/min], for example.

A method of the type described above is described in the publication "Automatische Störfallerkennung auf Autobahnen mit Hilfe von Fuzzy-Logik" ("Automatic Disruption Recognition on Highways Using Fuzzy Logic"), published by Siemens AG, Munich, Bereich Anlagentechnik (Systems Technology Division), Geschäftsgebiet Strassenverkehrstechnik (Road Traffic Technology Business Department). The known method essentially comprises two major components: data processing and fuzzy decision logic. In the data processing component, the three indicators "Speed Density Difference" (VK-Diff), "Trend Factor", and "Trend in Traffic Flow", which are designated as the basic values for disruption recognition, are essentially calculated from the average values of the speed and traffic flow, which are averaged respectively from a finite measurement interval. These three indicators serve as input variables for the fuzzy decision logic, which provides a disruption probability as an output value. The fuzzy decision logic comprises a three-tiered or three-stage structure, and consists of the three modules "Ruck or pack Recognition", "Disruption pre-Investigation", and the actual core module, the so-called "Disruption Recognition". This core module provides as an output value a so-called disruption probability, which is given in a range from 0 to 100%.

Due to the very complicated, but nevertheless more likely expedient definition of the indicator "Speed Density Difference", the known method works reliably without time delay only in very specific traffic conditions. The reliability of the disruption recognition is inadequate, especially in the case of disruptions that occur in the rear area of the monitored road sector. Even by using a fuzzy decision logic as a decision system for combining the utilized indicators, these basic inadequacies of the method could not be eliminated, but could only be ameliorated somewhat.

Furthermore, methods are generally known in which the detection of a disruption is essentially derived from the overcongestion or overflowing of a measurement cross-section, i.e. a disruption is recognized when vehicles have already come to a standstill on a measurement cross-section or pass through the measurement cross-section only at a very low speed. These so-called local methods have the serious disadvantage that, depending on the distance between the disruption and the measurement cross-section, valuable time is lost until the disruption is detected. Particularly when the road sector to be monitored is very long, which is always desirable for cost reasons because of the corresponding reduced number of measurement cross-sections, a very long period of time passes between the occurrence of a disruption a short distance before (i.e. upstream of) a measurement cross-section and the time in which the tail end of the forming traffic jam reaches the next upstream measurement cross-section. Since the vehicles approaching the tail end of the traffic jam from behind cannot be warned during this dead-time that is inherent to the system, there is a substantial risk that rear-end collisions will occur at the end of the traffic jam as a secondary consequence of the primary disruption.

Further, a brochure from the company AVE Verkehrs— und Informationstechnik GmbH, Aachen, with the title ("MAVE—die Komplettlösung für modernes Verkehrsmanagement" ("MAVE—The Complete Solution for Modern Traffic Management"), describes another method for recognizing disruptions in road traffic, which is based on the determination and analysis of traffic parameters that are specific to the stretch of road. With this approach which is based on the so-called method of "pattern recognition", the individual vehicle signals acquired at the measurement cross-sections are evaluated, in that characteristic patterns are derived, analyzed, and normalized. The measured data (pattern characteristics) that have been prepared or preprocessed in this manner are respectively transmitted to the stretch-of-road station allocated to the next downstream measurement cross-section and are continuously compared there with the analyzed data of the exit cross-section. With the help of suitable correlation methods, so-called stretch-of-road system functions are formed, from which can be derived the road-stretch specific traffic parameters: "Travel Time" (and therewith the mean travel speed) of the observed collective or convoy of vehicles in the section of the stretch of road between the entrance and exit measurement cross-sections, as well as "Traffic Density" in the section of the stretch of road between the entrance and exit measurement cross-sections.

Such methods, however, place very high demands on measurement technology and on data transfer capacities, so that, in addition to data transfer between the stretch-of-road stations allocated to the respective individual measurement cross-sections and a central evaluation location, direct connections among the neighboring stretch-of-road stations are also required.

These hardware prerequisites are generally not met with the measuring, transfer, and evaluating equipment that is currently being used to carry out the methods according to the state of the art. Thus, very cost-intensive retrofitting would be required to be able to use such methods that are specific to the stretch of road. Furthermore, all the techniques for traffic data acquisition (i.e. for measuring local speeds, the traffic flow, as well as the composition of the traffic) currently in use or still in development, which are essentially represented by induction loops, microwave sensors (radar), laser scanners, and video cameras, with subsequent evaluation of the indicated data by special computer programs, are subject to relatively large uncertainties. Particularly the detection of passenger vehicles is therein susceptible to error. In practice, individual vehicles are frequently not detected, for example if they are changing lanes in the measurement cross-section area. Also, it is possible that data acquisition apparatus specific to the lanes or even specific to the measurement cross-sections can fail. For this reason, methods based on traffic data acquisition that are specific to the stretch of road, in which the reliability of detecting the vehicles is of central importance, provide only unsatisfactory results.

Known methods for disruption recognition evaluate by real-time processing the average values that accumulate in the processing center and that are calculated by cyclically compiling the acquired measured data. The data situation is unreliable, however, because the detection of the vehicles is never 100% reliable.

Various approaches exist for making decisions under uncertainties or based on uncertain data, among which, methods for signal conditioning as well as statistical methods are also being used according to the state of the art in traffic engineering, in addition to the above described methods of fuzzy logic.

A disadvantage with signal conditioning, which is usually carried out in the form of exponential smoothing, is that parameters must be maintained and adjusted for each measurement cross-section and for all individual or single data, which results in a very great expense and effort for parameterization. Statistical methods, on the other hand, have the disadvantage that they are insignificant because the total population is missing in the individual decision.

SUMMARY OF THE INVENTION

It is the object of the invention to suggest a method with which disruptions in road traffic can be recognized, independent of the traffic condition, with the smallest possible loss of time and with low investment in data processing and measuring technology.

Starting from a method of the type described initially above, this object is solved in that a prognosis value of the traffic flow at the end of a road sector is calculated cyclically from the average values of the traffic flow and the speed of the vehicles determined at the beginning of the road sector, the length of the road sector, an assumption for the time distribution of the vehicles within the measurement interval, and an assumption for the progression of the speed of the vehicles while traveling through the road sector, whereby a) a transit time is determined from the length of the road sector and the assumption for the progression of speed of the vehicles while traveling through the sector;

b) the numbers of those measurement intervals in which the vehicles detected at the beginning of the road sector in the respective measurement interval pass through the measurement cross-section at the end of the road sector are determined from this transit time;

c) taking into account the assumption for the time distribution of the vehicles, proportion factors for distributing or apportioning the average value of the traffic flow to the measurement intervals determined according to b) are determined; and d) the prognosis value for the traffic flow is calculated by summing the products of the proportion factors and the associated traffic flows, whereby summation encompasses all previous measurement intervals and the current measurement interval, at the end of the road sector, a comparison is carried out cyclically between the prognosis value of the traffic flow and the average value of the traffic flow that was determined from the data acquired at the measurement cross-section at the end of the road sector, and the respective traffic flow difference is determined, a cycle-overlapping or —spanning summation of the values of the traffic flow difference is carried out and the number of additional vehicles remaining in the road sector to be monitored is continuously determined, and a disruption message is triggered when the number of additional vehicles remaining in the road sector exceeds a threshold value.

A disruption recognition that is very reliable and to a large extent independent of the respective specific traffic condition can be achieved by carrying out according to the invention a continuous, dynamic balancing of the vehicles that are additionally driving into the monitored road sector. In a disruption-free traffic condition, the traffic flowing into the monitored road sector can be detected again at the exit of the road sector, taking into account the averaged speeds, the driving behavior, the length of the road sector, and a distribution assumption.

According to the method of the invention, the proportion of the vehicles detected during a detection cycle that will leave the monitored road sector during the same cycle, or only during the following cycle, or during a later cycle is taken into consideration when determining the prognosis value of the traffic flow for the vehicles passing through the end of the road sector. The proportion factors are determined for this purpose and are used in apportioning the collective or convoy of vehicles that was detected at the beginning of the road sector in one detection cycle, to both cycles during which the proportions of the collective of vehicles will presumably leave the road sector again.

The method according to the present invention reliably avoids the disadvantages of conventional methods that merely observe the measured data of the measurement cross-sections at the beginning and the end of the road sector, simultaneously and independent of the topology of the stretch of road, and that can achieve only a relatively unreliable disruption recognition, even with the construction of complicated analysis criteria. Thus, with the method of the invention, the data processing effort is at a very low level that is most comparable with methods for disruption recognition on the basis of local measured values. However, the serious disadvantages of those known methods, namely that it is only possible to recognize a disruption when the traffic jam or congestion overflows a measurement cross-section, are avoided by the present invention, since, due to the dynamic balancing, any possible disruptions are detectable very quickly and nearly independent of their position within the monitored road sector.

Compared to the methods known according to the state of the art, in which traffic parameters specific to the stretch of road are determined and analyzed, and consequently which require an enormously high data processing effort because of the correlation of groups of vehicles at the beginning and at end of the road sector by means of a pattern recognition, this effort in the method of the invention is very low. It is not necessary to calculate complicated indicators, such as for example, the speed density difference (VK-Diff) or special trend factors. This also applies to the analysis of the measured data for the possible presence of a ruck or pack of vehicles, which, if not detected and adequately taken into consideration, would falsify the results of methods that are specific to the stretch of road.

A comparison with known methods, such as for example the method based on the three indicators "speed density difference", "trend factor", "and trend of traffic flow", clearly shows that traffic disruptions are more reliably and more quickly recognizable with the method according to the invention. Very high certainties are attainable with this method, even with long road sectors, and the results are influenced only very little by the location of the disruption within the road sector, which does not apply to the known methods.

The method according to the invention can also be applied very economically because an additional, direct connection between the stretch-of-road stations allocated to the measurement cross-sections, such as is absolutely required by methods based on traffic parameters that are specific to the stretch of road, can be avoided, and also because the spacing distances between two measurement cross-sections, i.e. the length of the road sector, can be dimensioned very large, due to the high reliability of disruption recognition.

DETAILED DESCRIPTION OF THE INVENTION

Figure 1:
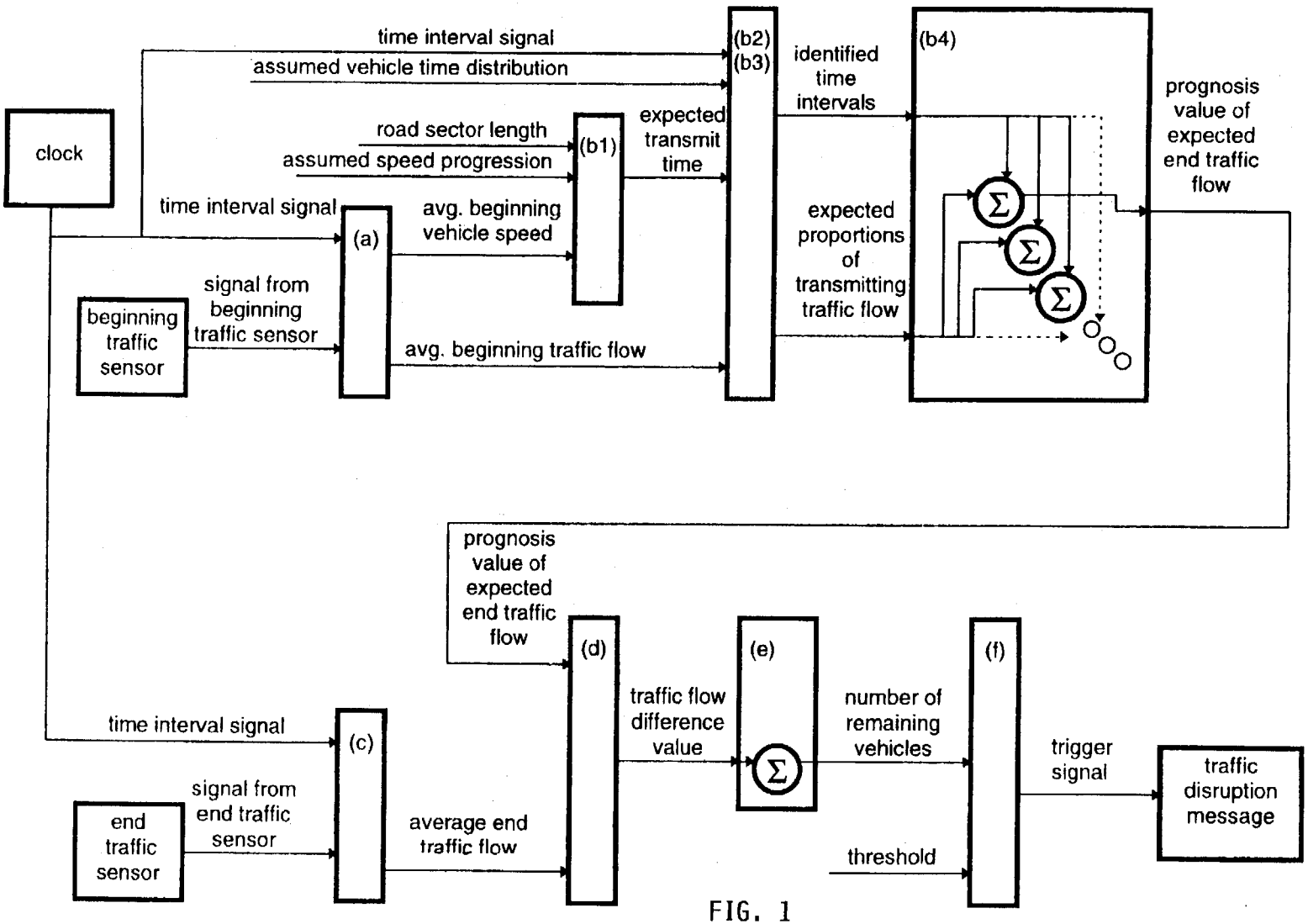
FIG. 1 is a flow diagram illustrating the method of the invention.

The calculation of the number of additional vehicles remaining in the monitored road sector, which is the basis for the disruption message, can be illustrated by the following formulas:

1. Calculation of the Transit Times

The transit time $TD_{i,z}$ that a vehicle requires to drive through the monitored road sector is:

$$TD_{i,z}=S_i/V_{i,z}$$

wherein:

$$v_{i,z}=(1/S_i)*\int_{s=0\ldots Si} v(s)ds$$

whereby:

$TD_{i,z}$ is the time the vehicles require to drive through the road sector;

v(s) is the assumed speed of a vehicle at the location s within the road sector;

$V_{i,z}$ is the speed averaged over the course of the stretch of road of the road sector $S_i$;

$S_1$ is the length of the road sector between the measurement cross-sections i and i+1;

s is the length variable with $s \in 0 \ldots S_1$;

and the indices:

i is the index for the measurement cross-sections, increasing in the direction of travel;

z is the index for detecting cycles, 1=current cycle, increasing into the past.

For v(s), it is necessary to make an assumption which should take into consideration the current traffic condition as well as the topology of the stretch of the road. For example, a reduction in speed is to be expected when driving through a steeply rising inclined stretch, particularly for vehicles with small motors. The same applies for very winding stretches, and the opposite for stretches with descending gradients. The dependence of v(s) on the traffic condition can follow from the measured speeds $vm_{i,z}$; the while topology of the stretch of road is taken into consideration through a correction factor. Therein:

$vm_{i,z}$ is the measured average value of the speed of the vehicles detected in the cycle z at the measurement cross-section i.

Assuming, for example, a constant traveling speed and no special topology of the stretch of road (no curves, ascents, descents), then it can be assumed that v(s)=constant=$vm_{i,z}$. Other assumptions are possible.

2. Distribution of the Detected Vehicles

Within the detection cycle z, the number of vehicles is counted at the measurement cross-section i. It can be determined from the transit time $TD_{i,z}$ when vehicles that enter the road sector in the current time cycle at the measurement cross-section i are to be expected at the measurement cross-section i+1. With a discrete observation of the time detecting, it can be determined in which detecting cycle which proportion of the vehicles leave the road sector. The proportion factors $n_{i,z}$ for the current cycle z=1 and the past cycles z>1 result from:

$$n_{i,z}=\text{Max}\ (0,(z-TD_{i,z}T))\ \text{for}\ TD_{i,z}<z*T$$

$$n_{i,z}=\text{Max}\ (0,(1-\text{Max}\ (0,\ (z-TD_{i,z}/T)))\ \text{for}\ TD_{i,1}\geqq z*T$$

wherein:

$n_{i,z}$ is the proportion factor of the current cycle; this proportion of the total number of vehicles that entered the road sector during the current cycle again leaves the road sector in the same cycle z at the measurement cross-section i+1 after the transit time $TD_{i,z}$; and T is the length of the detecting cycle.

3. Determination of the prognosis Value of the Traffic Flow

The prognosis value for the traffic flow can thus be determined from the counted vehicles, an assumption about the time distribution of the detected vehicles over the detecting cycle T, and the determined proportion factors of the vehicles.

Thereby a distribution assumption x=P(t) over the time t $\epsilon 0 \ldots T$ is used as a basis for the vehicles detected during the cycle. Generally a simple uniform distribution of the vehicles can be used.

The prognosis value of the traffic flow results as:

$$PQ_{i+1,1}=\Sigma_{(z=1\ldots Z)}P(n_{i,z})*Q_{i,z}$$

wherein:

$PQ_{1+i}$ is the current prognosis value (z=1) of the traffic flow at the measurement cross-section i+1;

$Q_{i,z}$ is the number of vehicles counted at the measurement cross-section i in the detecting cycle z; and $P(n_{i,z})$ is the proportion of vehicles $Q_{i,z}$ that exit at the measurement cross-section i+1 in the cycle z, determined from the distribution assumption; for example, assuming a uniform distribution $P(n_{i,z})=n_{i,z}$.

4. Determination of the Difference in Traffic Flow

The difference in traffic flow $DQ_{i,z}$ is determined as:
ti $DQ_{i,z}=PQ_{i,z}-Q_{i,z}$ wherein:

$DQ_{i,z}$ is the difference in traffic flow at the measurement cross-section i in the detecting cycle z;

$PQ_{i,z}$ is the prognosis value of the traffic flow at the measurement cross-section i in the detecting cycle z; and $Q_{i,z}$ is the number of vehicles counted at the measurement cross-section i in the detecting cycle z.

5. Determination of Excess Vehicles

The number $BDQ_i$ of the additional vehicles remaining in the monitored road sector is determined from:

$$BDQ_i=\Sigma_{(z=1 \ldots Z)}DQ_{i,z}$$

or recursively from $$BDQ_i=BDQ_{i,old}=DQ_{i,z}$$

wherein:

$BDQ_i$ is the number of vehicles in the road sector between the measurement cross-sections i−1 and i;

$DQ_{i,z}$ is the difference in traffic flow at the measurement cross-section i in the detecting cycle z; and Z is the number of cycles within which the summation is carried out.

Measurement errors can be excluded from the summation by expanding through calibrating to 0 (a negative number of vehicles is conceivable only with start-up transients or detection problems) or, in the recursive method, by attenuation.

A disruption message is triggered if the quantity $BDQ_i$ exceeds a certain (for example, a threshold value dependent upon the traffic condition). The disruption message can be different, depending on the gravity of the disruption, i.e. the magnitude of $BDQ_i$, in order to urge the successive following vehicles to adopt a driving behavior appropriate for the special case.

A particularly advantageous embodiment of the invention exists in that the calculation of the prognosis value of the traffic flow is carried out separately for each traffic lane in one travel direction, and in that a cyclical comparison is carried out between the sum of the prognosis values of all traffic lanes in one travel direction and the value of the traffic flow determined at the measurement cross-section at the end of the road sector. The reliability of the prognosis value can be increased with the aid of this individual observation of lanes of traffic, since more precise assumptions can be made about driving behavior and the time distribution of the vehicles for a single lane of traffic. Individual prognoses for each lane of traffic with its respective specific driving behavior (right lane: truck traffic; left lane(s): passing traffic) and subsequent summation will thus deliver better results than forming a sum before the prognosis, which leads to a loss of information.

According to a further embodiment of the method of the invention, it is suggested that a fuzzy logic be used to trigger the disruption message, whereby, in addition to the number of the additional vehicles remaining in the road sector, at least one input value describing the traffic condition is used in the fuzzy logic.

The term traffic condition in this context is understood to relate to the speed of the vehicles (possibly averaged over several cycles), the traffic flow and the density of traffic (which is equal to traffic flow/speed or number of cars per unit distance) the standard deviation of the speed (as a measure for the "unrest" in the traffic flow), and the topological or metereological quantities, whereby it is not necessary to refer to all of the above mentioned quantities when defining the input quantities describing the traffic condition. An advantage of taking the traffic condition into account in triggering the disruption message is that the reliability of the method increases substantially. In this manner, it is possible to adapt the method according to the invention particularly simply to various application sites and conditions, since a time-consuming adjustment and calibration of rigid threshold values is eliminated.

This same effect of an increase in reliability also results when, in a further embodiment of the method according to the invention, the describable uncertainty as to when false detections occur at a measurement cross-section are taken into account by the fuzzy logic and are thus used in triggering the disruption message.

A further embodiment of the method according to the invention further exists in that the fuzzy logic provides an output value that describes the type of disruption.

In this manner, depending on the gravity of the disruption, various disruption messages can be generated (for example: "slow moving traffic" or "complete standstill" of the vehicles). The traffic moving toward the disruption site can thus be effectively warned and urged to adopt a respective appropriate driving behavior.

Furthermore, it is particularly advantageous when the progression of the speed of the vehicles while driving through the road sector is described with the help of fuzzy logic. In this way, the describable uncertainties as to how the drivers of the vehicles in their manner of driving utilize their room to maneuver, which is dependent on the respective particular traffic condition, can be taken into consideration in an advantageous manner when determining the prognosis value of the traffic flow at the end of the road sector. This results in an additional increase in the reliability of the method according to the invention.

In a further embodiment of the invention, it is provided that only the traffic flow and the speed of trucks are evaluated as measured data for the disruption recognition, as long as the proportion of the trucks relative to the total traffic flow exceeds a certain threshold value.

Experience shows that speeds of trucks are subject to noticeably smaller fluctuations than those of passenger vehicles, so that this measure further increases the reliability of the disruption recognition. A reinforcement of this positive effect is expected to occur with the introduction of the future required EU speed regulator for trucks, which limits the top speed of trucks to a maximum of 88 km/h. Also, with today's detecting techniques, trucks are detected with much greater certainty than are passenger vehicles. At times when the proportion of trucks in the total traffic flow falls below a threshold value that is required for a reliable recognition of disruptions, it makes sense to change over to detecting all vehicles, i.e. both passenger vehicles and trucks. Furthermore, it is particularly advantageous, if the measured data acquired at the end of a road sector are simultaneously used as measured data at the beginning of the following road sector.

In this way, an observation specific to one road sector can be expanded in a simple and very cost-advantageous manner to a full monitoring of a total route comprising several road sectors. Therein, each measurement cross-section thereby simultaneously represents the measurement cross-section at the end of the Road Sector i as well as at the beginning of Road Sector i+1.

Although the invention has been described with reference to specific example embodiments it will be appreciated that it is intended to cover all modifications and equivalents within the scope of the appended claims.

We claim:

1. A method for recognizing a disruption in traffic of vehicles travelling in a road sector of a road that has a certain road sector length, wherein a beginning traffic sensor is arranged at a beginning measurement cross-section at a beginning of said sector and an end traffic sensor is arranged at an end measurement cross-section at an end of said sector, said method comprising, in a plurality of successive finite measurement time intervals:

(a) using a signal provided by said beginning traffic sensor, determining an average beginning vehicle speed and an average beginning traffic flow of vehicles passing said beginning measurement cross-section, averaged over a respective present one of said time intervals;

(b) calculating a prognosis value of an expected end traffic flow of vehicles passing said end measurement cross-section during said respective present time interval, from said average beginning vehicle speed, said average beginning traffic flow, said road sector length, an assumed time distribution of vehicles in said respective present time interval, and an assumed progression of speed of vehicles while travelling through said road sector, comprising:

(b1) determining an expected transit time, from said road sector length, said average beginning vehicle speed, and said assumed progression of speed, (b2) from said expected transit time, identifying particular one or ones of said successive measurement time intervals during which vehicles sensed by said beginning traffic sensor during said respective present time interval will pass said end measurement cross-section, (b3) determining proportion factors for apportioning said average beginning traffic flow to said particular one or ones of said time intervals identified in said step (b2), and (b4) calculating said prognosis value for said respective present time interval by multiplying said proportion factors with corresponding ones of said average beginning traffic flow for said particular one or ones of said time intervals identified in said step (b2), to provide expected traffic flow products, and then summing said expected traffic flow products over said respective present time interval and all previous ones of said time intervals;

(c) using a signal provided by said end traffic sensor, determining an average end traffic flow of vehicles passing said end measurement cross-section, averaged over said respective present time interval;

(d) determining a respective traffic flow difference value by comparing said prognosis value and said average end traffic flow;

(e) summing said respective traffic flow difference value as determined for said respective present time interval and for all previous ones of said time intervals to determine an excess number of vehicles remaining in said road sector;

(f) triggering a traffic disruption message if said excess number of vehicles remaining in said road sector exceeds a threshold value; and (g) repeating said steps (a) to (f) for each of said successive time intervals.

2. The method of claim 1, wherein each said measurement cross-section encompasses all lanes of traffic that are available for travel in one direction in said road sector.

3. The method of claim 1, wherein said road sector has plural lanes of traffic for one direction of travel, said step (b) of calculating said prognosis value is carried out separately for each one of said plural lanes of traffic to provide a plurality of single-lane prognosis values, and said step (d) further comprises summing all of said single-lane prognosis values for said one direction of travel to provide a total prognosis value, which is then compared with said average end traffic flow to determine said traffic flow difference value.

4. The method of claim 3, wherein said step (f) comprises evaluating said excess number of vehicles and at least one value describing a traffic condition as respective inputs in a fuzzy logic circuit, and releasing an output signal from said fuzzy logic circuit to trigger said traffic disruption message.

5. The method of claim 1, wherein said step (f) comprises evaluating said excess number of vehicles and at least one value describing a traffic condition as respective inputs in a fuzzy logic circuit, and releasing an output signal from said fuzzy logic circuit to trigger said traffic disruption message.

6. The method of claim 5, wherein at least one of said sensors makes an erroneous detection at at least one of said measurement cross-sections, and wherein said fuzzy logic circuit takes into account describable uncertainties regarding said erroneous detection.

7. The method of claim 6, wherein said step (f) comprises triggering a selected one of a plurality of disruption messages corresponding to a plurality of different disruption situations, and wherein said output signal from said fuzzy logic circuit particularly triggers said selected disruption message.

8. The method of claim 5, wherein said step (f) comprises triggering a selected one of a plurality of disruption messages corresponding to a plurality of different disruption situations, and wherein said output signal from said fuzzy logic circuit particularly triggers said selected disruption message.

9. The method of claim 8, wherein said assumed progression of speed of vehicles is determined by means of fuzzy logic.

10. The method of claim 9, wherein said vehicles include trucks and other vehicles, further comprising a step of determining an average total traffic flow and an average truck traffic flow using a signal provided by said beginning traffic sensor, and calculating a truck proportion as said truck traffic flow divided by said total traffic flow, and wherein as long as said truck proportion exceeds a threshold value, said average beginning vehicle speed is an average beginning speed of only said trucks among said vehicles and said average beginning traffic flow is an average beginning traffic flow of only said trucks among said vehicles.

11. The method of claim 10, wherein said road includes a plurality of said road sectors arranged successively adjacent one another, wherein said end traffic sensor of a first one of said road sectors is simultaneously used as said beginning traffic sensor of a second one of said road sectors adjacently following said first road sector, and wherein said signal provided by said end traffic sensor of said first sector is simultaneously used as said signal provided by said beginning traffic sensor of said second sector.

12. The method of claim 1, wherein said road includes a plurality of said road sectors arranged successively adjacent one another, wherein said end traffic sensor of a first one of said road sectors is simultaneously used as said beginning traffic sensor of a second one of said road sectors adjacently following said first road sector, and wherein said signal provided by said end traffic sensor of said first sector is simultaneously used as said signal provided by said beginning traffic sensor of said second sector.

13. The method of claim 1, wherein said vehicles include trucks and other vehicles, further comprising a step of determining an average total traffic flow and an average truck traffic flow using a signal provided by said beginning traffic sensor, and calculating a truck proportion as said truck traffic flow divided by said total traffic flow, and wherein as long as said truck proportion exceeds a threshold value, said average beginning vehicle speed is an average beginning speed of only said trucks among said vehicles and said average beginning traffic flow is an average beginning traffic flow of only said trucks among said vehicles.

14. The method of claim 1, wherein said assumed progression of speed of vehicles is determined by means of fuzzy logic.

* * * * *

UNITED STATES PATENT AND TRADEMARK OFFICE

CERTIFICATE OF CORRECTION

PATENT NO. : 5,684,475

DATED : Nov. 4, 1997

INVENTOR(S) : Krause et al.

It is certified that error appears in the above-identified patent and that said Letters Patent is hereby corrected as shown below:

| | | |
|---|---|---|
| On the title page, [21], | | replace "639,957" by --639,967--; |
| Col. 1, | line 65, | replace "pre-" by --Pre--; |
| Col. 2, | line 35, | replace "AVE" by --ave--; |
| Col. 5, | line 61, | replace "$S_1$" by --$S_i$--; |
| | line 62, | replace "i+1;" by --i+1; and--; |
| | line 63, | replace "$S_1$;" by --$S_i$;--; |
| | line 66, | replace "travel;" by --travel; and--; |
| Col. 6, | line 11, | replace "the while" by --while the--; |
| | line 32, | replace "$(z\text{-}TD_{i,z}T))$" by --$(z\text{-}TD_{i,z}/T))$--; |
| Col. 7, | line 2, | delete "ti"; |
| Col. 8, | line 1, | after "distance)" insert --,--. |

Signed and Sealed this

Twentieth Day of January, 1998

*Attest:*

*Attesting Officer*

BRUCE LEHMAN

*Commissioner of Patents and Trademarks*